US011679610B2

(12) United States Patent
Yamasaki

(10) Patent No.: US 11,679,610 B2
(45) Date of Patent: Jun. 20, 2023

(54) IMAGE FORMING APPARATUS AND HEAD UNIT POSITIONING METHOD

(71) Applicant: KYOCERA Document Solutions Inc., Osaka (JP)

(72) Inventor: Shunsuke Yamasaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/691,177

(22) Filed: Mar. 10, 2022

(65) Prior Publication Data

US 2022/0288958 A1 Sep. 15, 2022

(30) Foreign Application Priority Data

Mar. 11, 2021 (JP) ..... 2021-039511

(51) Int. Cl.
*B41J 25/308* (2006.01)

(52) U.S. Cl.
CPC ..... *B41J 25/308* (2013.01)

(58) Field of Classification Search
CPC ..... B41J 25/308
See application file for complete search history.

(56) References Cited

FOREIGN PATENT DOCUMENTS

JP 6321920 B2 5/2018

*Primary Examiner* — Scott A Richmond
(74) *Attorney, Agent, or Firm* — Studebaker & Brackett PC

(57) ABSTRACT

An image forming apparatus includes a conveyance part, a head unit, a distance changing part, three blocks and three pins. The distance changing part moves the head unit between a printing position where a printing operation is performed and a retreat position separated away from the conveyance part farther than the printing position. The three blocks are provided in one of the conveyance part and the head unit at intervals in the conveyance direction and a width direction crossing the conveyance direction. The three pins are provided in the other of the conveyance part and the head unit at positions facing the three blocks. Each of the three blocks has a positioning groove having a pair of inclined surfaces. The pins come into two-point contact with the inclined surfaces of the blocks in a state where the head unit is positioned in the printing position.

10 Claims, 9 Drawing Sheets

IMAGE FORMING APPARATUS AND HEAD UNIT POSITIONING METHOD

INCORPORATION BY REFERENCE

This application is based on and claims the benefit of priority from Japanese patent application No. 2021-039511 filed on Mar. 11, 2021, which is incorporated by reference in its entirety.

BACKGROUND

The present disclosure relates to an image forming apparatus and a head unit positioning method.

A sheet digital printing apparatus is known, in which an inkjet nozzle unit is supported by a frame in a movable manner between a printing position where the nozzle unit is closer to a sheet and prints an image on the sheet and a retreat position where the nozzle unit is separated away from the sheet. In the sheet digital printing apparatus, the frame is provided with a tapered pin and the nozzle unit is provided with a tapered hole formed to be complementary to the tapered pin. By fitting the tapered pin in the tapered hole, the inkjet nozzle head is positioned to the printing position with precision.

However, in the sheet digital printing apparatus described above, unless the angle (the shape) and the size of the tapered pin and the tapered hole are matched with each other with high accuracy, it becomes impossible to fit the tapered pin in the tapered hole accurately. Therefore, a slight accuracy error between the tapered pin and the tapered hole may cause rattling or inaccurate positioning.

SUMMARY

In accordance with an aspect of the present disclosure, an image forming apparatus includes a conveyance part, a head unit, a distance changing part, three blocks and three pins. The conveyance part conveys a medium along a conveyance direction. The head unit is disposed so as to face the conveyance part and ejects liquid droplets to the medium. The distance changing part moves the head unit between a printing position where a printing operation is performed on the medium and a retreat position separated away from the conveyance part farther than the printing position. The three blocks are provided in one of the conveyance part and the head unit at intervals in the conveyance direction and a width direction crossing the conveyance direction. The three pins are provided in the other of the conveyance part and the head unit at positions facing the three blocks. Each of the three blocks has a positioning groove having a pair of inclined surfaces which are inclined such that the positioning groove becomes narrower as the positioning groove is separated away from the other of the conveyance part and the head unit. The three blocks contain two first blocks in which the positioning grooves are extended along one of the conveyance direction and the width direction, and the inclined surfaces are formed in the same direction; and one second block in which the positioning groove is extended along the other of the conveyance direction and the width direction, and the inclined surfaces are formed in a direction of the inclined surfaces of the first block which is turned by an angle between the conveyance direction and the width direction in a plan view. The pins come into two-point contact with the inclined surfaces of the blocks in a state where the head unit is positioned in the printing position.

In accordance with an aspect of the present disclosure, a head unit positioning method, in which the head unit is disposed so as to face a conveyance part conveying a medium along a conveyance direction and is movable between a printing position where the head unit ejects ink droplets to the medium to perform a printing operation and a retreat position separated away from the conveyance part farther than the printing position, includes a step for providing three blocks, a step for providing three pins and a positioning step. In the step for providing three blocks, three block are provided in one of the conveyance part and the head unit at intervals in the conveyance direction and a width direction crossing the conveyance direction. Each of the three blocks has a positioning groove having a pair of inclined surfaces which are inclined such that the positioning groove becomes narrower as the positioning groove is separated away from the other of the conveyance part and the head unit. The three blocks contain two first block and one second block. In the two first blocks, the positioning grooves are extended along one of the conveyance direction and the width direction, and the inclined surfaces are formed in the same direction. In one second block, the positioning groove is extended along the other of the conveyance direction and the width direction, and the inclined surfaces are formed in a direction of the inclined surfaces of the first block which is turned by an angle between the conveyance direction and the width direction in a plan view. In the step for providing three pins, three pins are provided in the other of the conveyance part and the head unit at positions facing the three blocks in a state where the head unit is positioned in the printing position. In the positioning step, the three pins are brought into two-point contact with the inclined surfaces of the three blocks.

The other features and advantages of the present disclosure will become more apparent from the following description. In the detailed description, reference is made to the accompanying drawings, and preferred embodiments of the present disclosure are shown by way of example in the accompanying drawings.

DETAILED DESCRIPTION

Hereinafter, with reference to the attached drawings, one embodiment in the present disclosure will be described. Fr, Rr, L, R, U and D marked in each figure indicate the front, the rear, the left, the right, the upper and the lower. Although the terms indicating direction and position are used in the specification, they are used for convenience of explanation and are not intended to limit the technical scope of the present disclosure.

Figure 1:
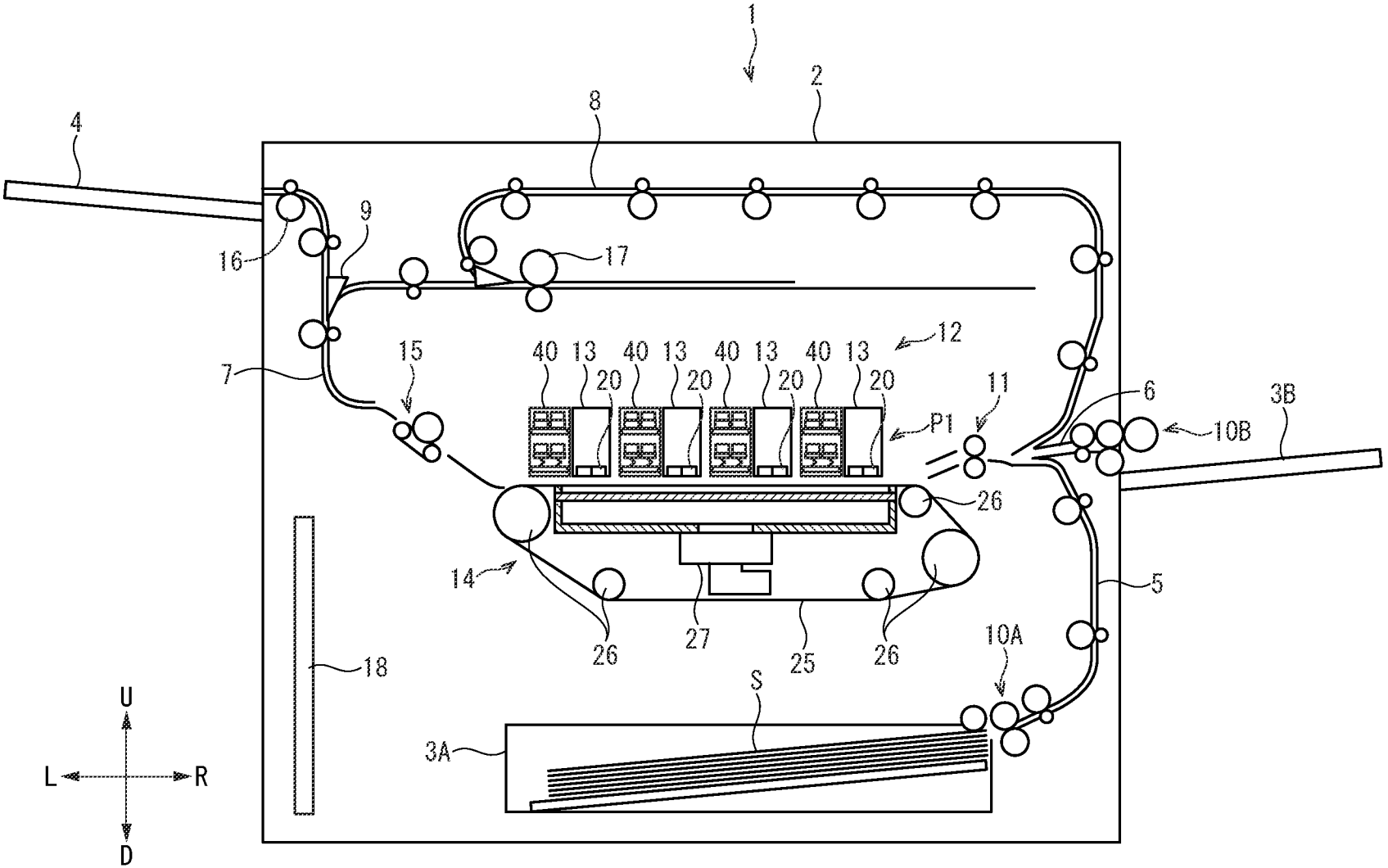
FIG. 1 is a front view schematically showing an inner structure of an image forming apparatus according to one embodiment of the present disclosure.

[Outline of Image Forming Apparatus] With reference to FIG. 1, an image forming apparatus 1 will be described. FIG. 1 is a front view schematically showing an inner structure of the image forming apparatus 1.

The image forming apparatus 1 is an inkjet printer that ejects ink droplets to form an image on a sheet S (a medium). The image forming apparatus 1 includes a box-shaped housing 2 in which various kinds of device are housed. In the lower portion of the housing 2, a sheet feeding cassette 3A in which the sheet S is set is housed, and a manual bypass sheet feeding tray 3B on which the sheet S is set manually is installed on the right side surface of the housing 2. On the upper portion of the left side surface of the housing 2, a sheet discharge tray 4 on which the image-formed sheet S is stacked is installed.

In the right side portion in the housing 2, a first conveyance path 5 is formed to convey the sheet S from the sheet feeding cassette 3A to an image forming part 12 provided in almost the center portion in the housing 2. On the upstream side portion of the first conveyance path 5, a sheet feeding part 10A which feeds the sheet S from the sheet stack on the sheet feeding cassette 3A is provided, and on the downstream side portion of the first conveyance path 5, a registration roller 11 is provided. The downstream end of the first conveyance path 5 is communicated with a sheet feeding path 6 extending from the manual bypass sheet feeding tray 6. On the sheet feeding path 6, a sheet feeding part 10B which feeds the sheet S from the sheet stack on the manual bypass tray 3B is provided.

The image forming part 12 includes a plurality of (for example, four) head units 13 corresponding to a plurality of colors (for example, black, cyan, magenta and yellow). Each head unit 13 includes one or more (for example, three) ejection heads 20 that eject ink droplets toward the sheet S (see FIG. 2). Each ejection head 20 has a nozzle surface 20A (see FIG. 2) on which a plurality of ejection nozzles (not shown) is opened, and ejects ink (liquid) through the ejection nozzles. In other words, the head unit 13 ejects the ink (the liquid). Each ejection head 20 communicates with an ink pack (not shown) containing the ink of each color through a tube (not shown), and the ink is supplied from the ink pack to the ejection head 20. In this embodiment, as described above, the head unit 13 includes three ejection heads 20. The number of ejection heads 20 included in the head unit 13 may be one. A positioning mechanism 50 described later may be provided on the ejection head 20. In such a case, one ejection head 20 corresponds to the head unit 13.

The image forming part 12 (the head unit 13) is disposed so as to face a conveyance part 14. Specifically, below the image forming part 12, a conveyance part 14 is provided to convey the sheet S along the left-and-right direction (a conveyance direction). The conveyance part 14 includes a conveyance belt 25 stretched between a plurality of tension rollers 26, a suction part 27 provided within an inner space of the conveyance belt 25, and a pair of conveyance frames 28 (see FIG. 3, and the others) that support the stretching rollers 26 and the suction part 27. The tension rollers 26 are supported by the pair of conveyance frames 28 in a rotatable manner around axes. A large number of through holes (not shown) is formed in the conveyance belt 25, and the suction part 27 generates negative pressure in the through holes of the conveyance belt 25.

On the left side of the image forming part 12 (on the downstream side in the conveyance direction), a decurl device 15 which conveys the sheet S while nipping it to correct the curl of the sheet S is provided. In the left side portion in the housing 2, a second conveyance path 7 is formed to convey the sheet from the decurl device 15 to the sheet discharge tray 4. On the downstream side of the second conveyance path 7, a sheet discharge part 16 which discharges the sheet S on the sheet discharge tray 4 is provided. On the middle of the second conveyance path 7, a branch member 9 which switches the destination of the sheet S into the sheet discharge tray 4 and a third conveyance path 8 described later is provided.

In the upper portion in the housing 2, the third conveyance path 8 along which the sheet S is conveyed from the branch member 9 on the middle of the second conveyance path 7 to the registration roller 11 is formed. On the middle of the third conveyance path 8, an inversion part 17 which inverse the sheet S upside down is provided.

The image forming apparatus 1 (the inside the housing 2) is provided with a controller 18 for appropriately controlling various controlled devices. The controller 18 includes a processor or the others which executes various kinds of arithmetic processing according to programs and parameters stored in the memory. The controller 18 may be implemented by a logic circuit (hardware) formed in an integrated circuit or the like instead of the processor or the like for executing the program or the like.

[Image forming Operation] Here, with reference to FIG. 1, an image forming operation of the image forming apparatus 1 will be described. The controller 18 appropriately controls the various controlled devices to perform the image forming operation as follows.

The sheet feeding parts 10A and 10B feed the sheet S fed from the sheet feeding cassette 3A or the manual bypass sheet feeding tray 3B to the first conveyance path 5 or the sheet feeding path 6. The registration roller 11 temporarily blocks the sheet S before printing (for one-side printing) to correct the skew, and feeds the sheet S before printing onto the conveyance belt 25 in accordance with the ejection timing of the ink droplets from the head unit 13 (the ejection heads 20). The sheet S is attracted on the conveyance belt 25 and conveyed to the downstream side by the traveling conveyance belt 25. The head unit 13 facing the conveyance part 14 from above ejects the ink droplets onto the sheet S on the conveyance belt 25 to form an image (print). The sheet S passed through the image forming part 12 is released from the attraction to the conveyance belt 25 and sent to the decurl device 15. The decurl device 15 corrects the curl of the sheet S.

When the one-side printing is performed, the branch member 9 opens the second conveyance path 7 and closes the third conveyance path 8. The sheet S printed on one side is discharged on the discharge tray 4 through the second conveyance path 7. When the both-side printing is performed, the branch member 9 closes the second conveyance path 7 and opens the third conveyance path 8. The sheet S printed on one side enters the third conveyance path 8, is inversed upside down by the inversion part 17, and is conveyed toward the registration roller 11 again. Thereafter, the image is formed on the back surface of the sheet S in the same order as in the one-side printing, and the curl of the sheet S printed on both sides is corrected, and then the sheet S is discharged on the sheet discharge tray 4.

By the way, the inkjet image forming apparatus 1 is provided with a plurality of (for example, four) maintenance parts 40 which maintains the ejection heads 20. The image forming apparatus 1 is further provided with a distance changing part 30 which changes a distance between each head unit 13 and the conveyance part 14. Specifically, the distance changing part 30 moves the head unit 13 in the upper-and-lower direction. The maintenance of the ejection head 20 is performed in a state where the head unit 13 is lifted from a position where the head unit 13 forms the image on the sheet S, that is, in a state where a distance between the head unit 13 and the conveyance part 14 is larger.

Figure 2:
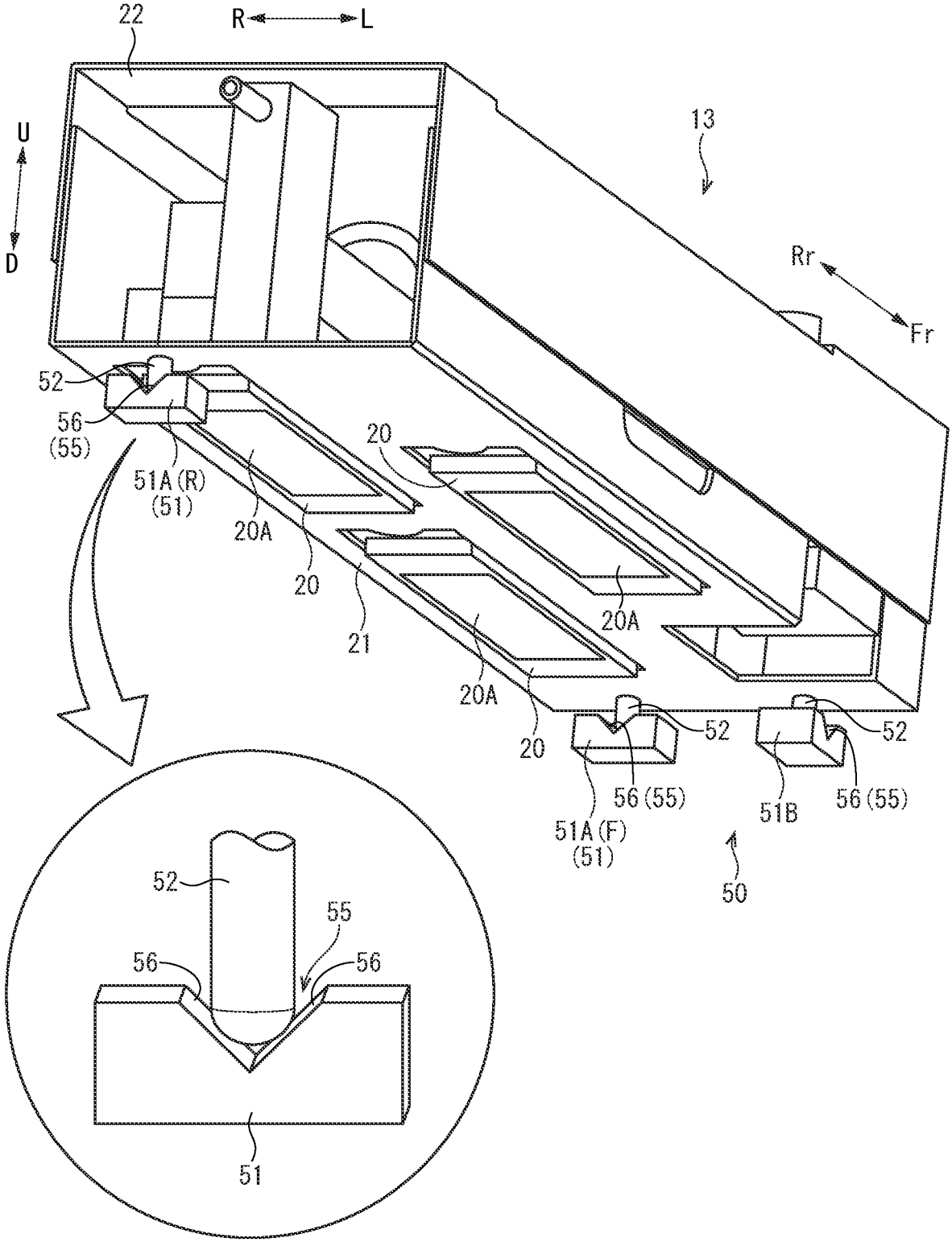
FIG. 2 is a perspective view showing a head unit and a positioning mechanism, in the image forming apparatus according to the embodiment of the present disclosure.
Figure 3:
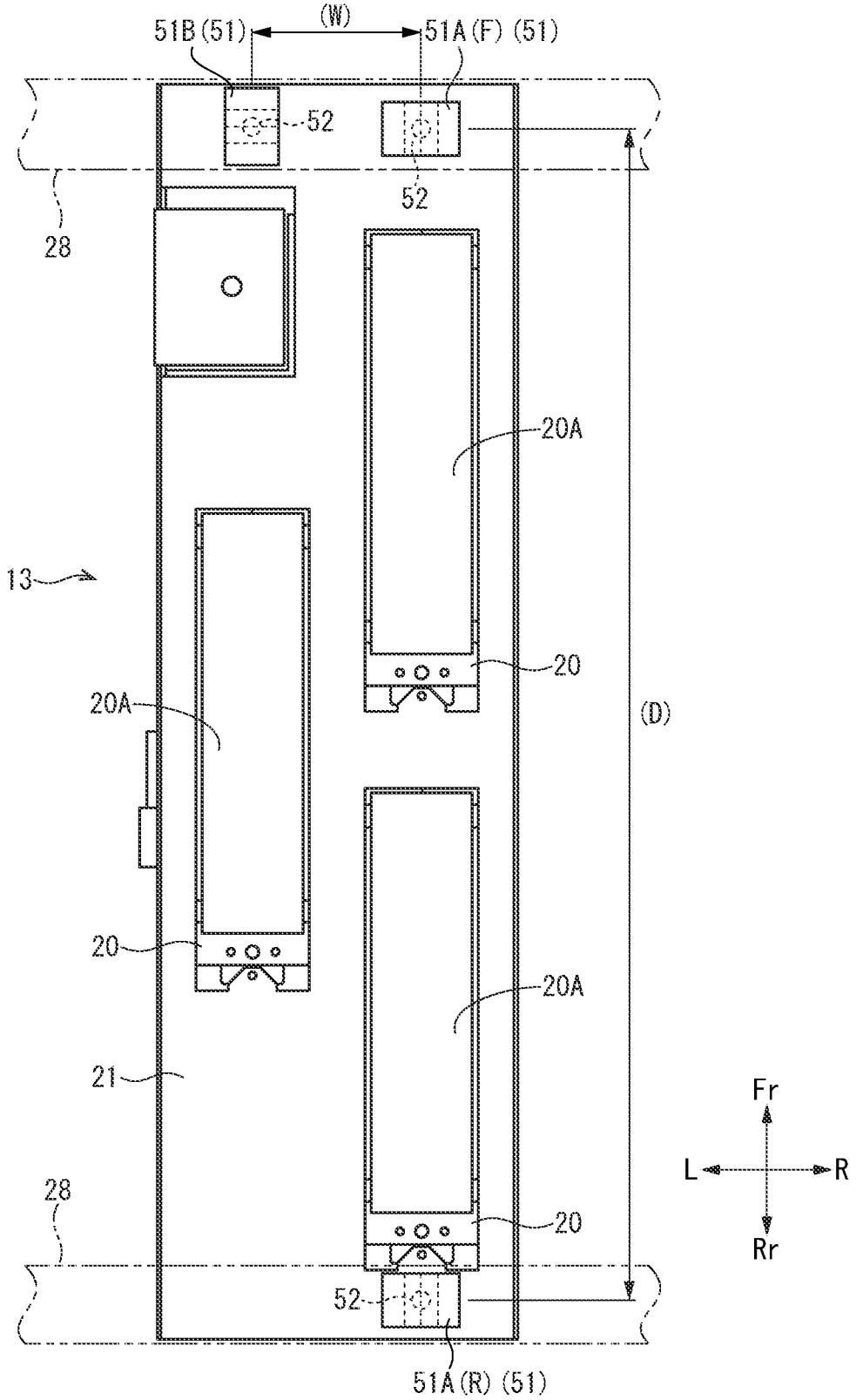
FIG. 3 is a bottom view showing the head unit and the positioning mechanism, in the image forming apparatus according to the embodiment of the present disclosure.
Figure 4:
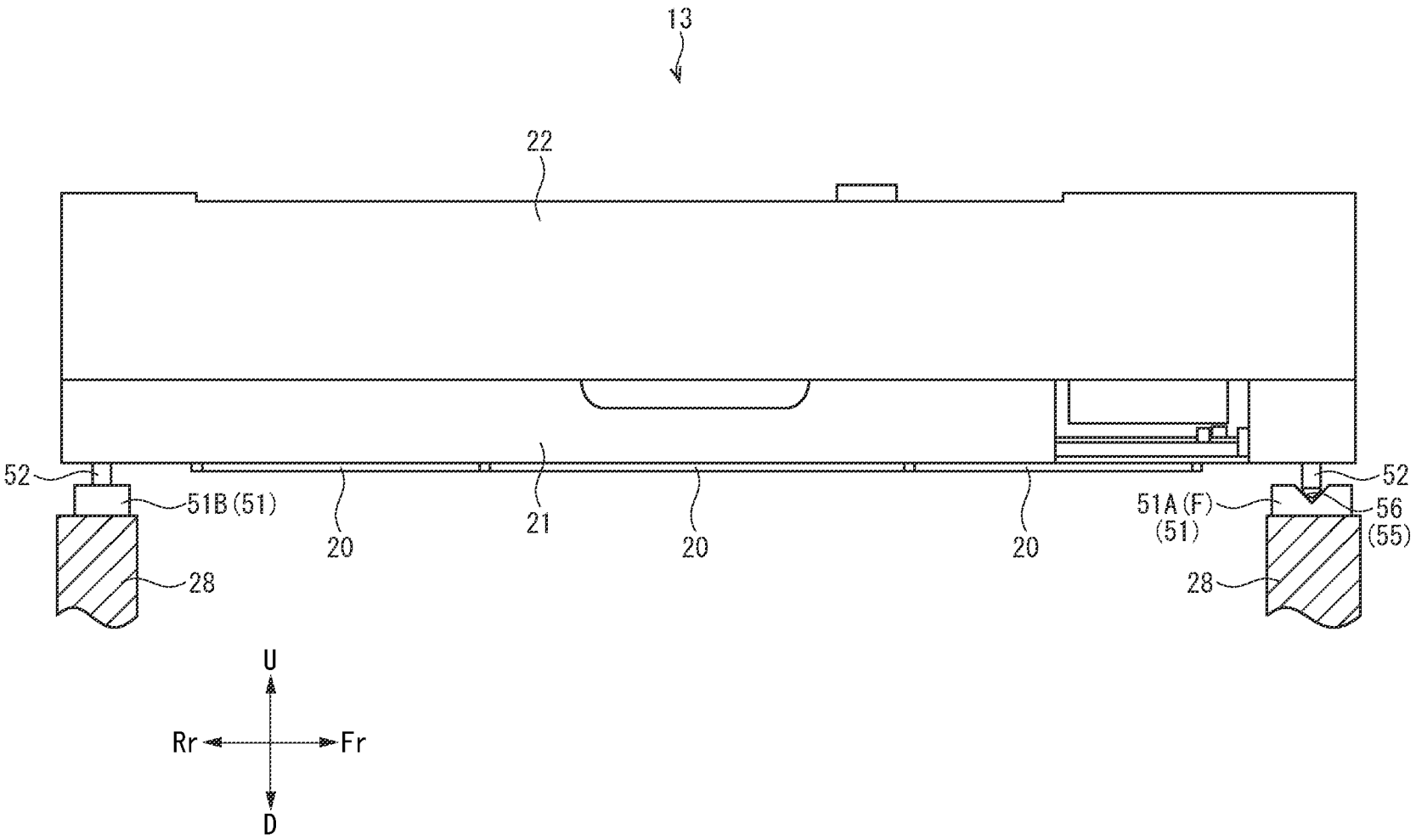
FIG. 4 is a side view showing the head unit and the positioning mechanism, in the image forming apparatus according to the embodiment of the present disclosure.

[Head Unit] First, with reference to FIG. 2 to FIG. 4, the head unit 13 will be described. FIG. 2 is a perspective view showing the head unit 13. FIG. 3 is a bottom view showing the head unit 13. FIG. 4 is a side view showing the head unit 13. The four head units 13 have almost the same structure, and in the specification, one head unit 13 will be described mainly. The three ejection heads 20 have almost the same structure, and in the specification, one ejection head 20 will be described mainly.

The head unit 13 includes the three ejection heads 20 which ejects the ink droplet and a holder 21 which supports the three head units 13. In the upper portion of the holder 21, a cover 22 is provided so as to cover the ejection heads 20. The head unit 13 is formed in almost a square cylindrical shape longer in the front-and-rear direction than in the left-and-right direction (the conveyance direction). In the embodiment, two first blocks 51A included in the positioning mechanism 50 described above have positioning grooves 55. The positioning groove 55 is formed along the width direction. In the embodiment, the width direction corresponds to the front-and-rear direction.

The ejection head 20 is formed in almost a parallelepiped shape long in the front-and-rear direction (the width direction crossing the conveyance direction (the left-and-right direction)). The ejection head 20 is a so-called piezo type inkjet head which applies a voltage to a piezoelectric element to deform it and ejects the ink. The ejection head 20 is not limited to the piezo type inkjet head, and may use another ink ejection method such as a thermal method.

The holder 21 is formed by bending a sheet metal into almost a U-shape, viewed from the front side, for example. The holder 21 has three openings disposed in a zigzag manner viewed from the front side, in which the ejection heads 20 are attached. Specifically, two openings are formed on the upstream side in the conveyance direction (the right side), and one opening is formed on the downstream side in the conveyance direction (the left side). The ejection head 20 is fixed to the holder 21 in a posture where the nozzle surface 20A is exposed downward through the opening. Therefore, the three ejection heads 20 are disposed in a zigzag manner in a plan view.

Figure 5:
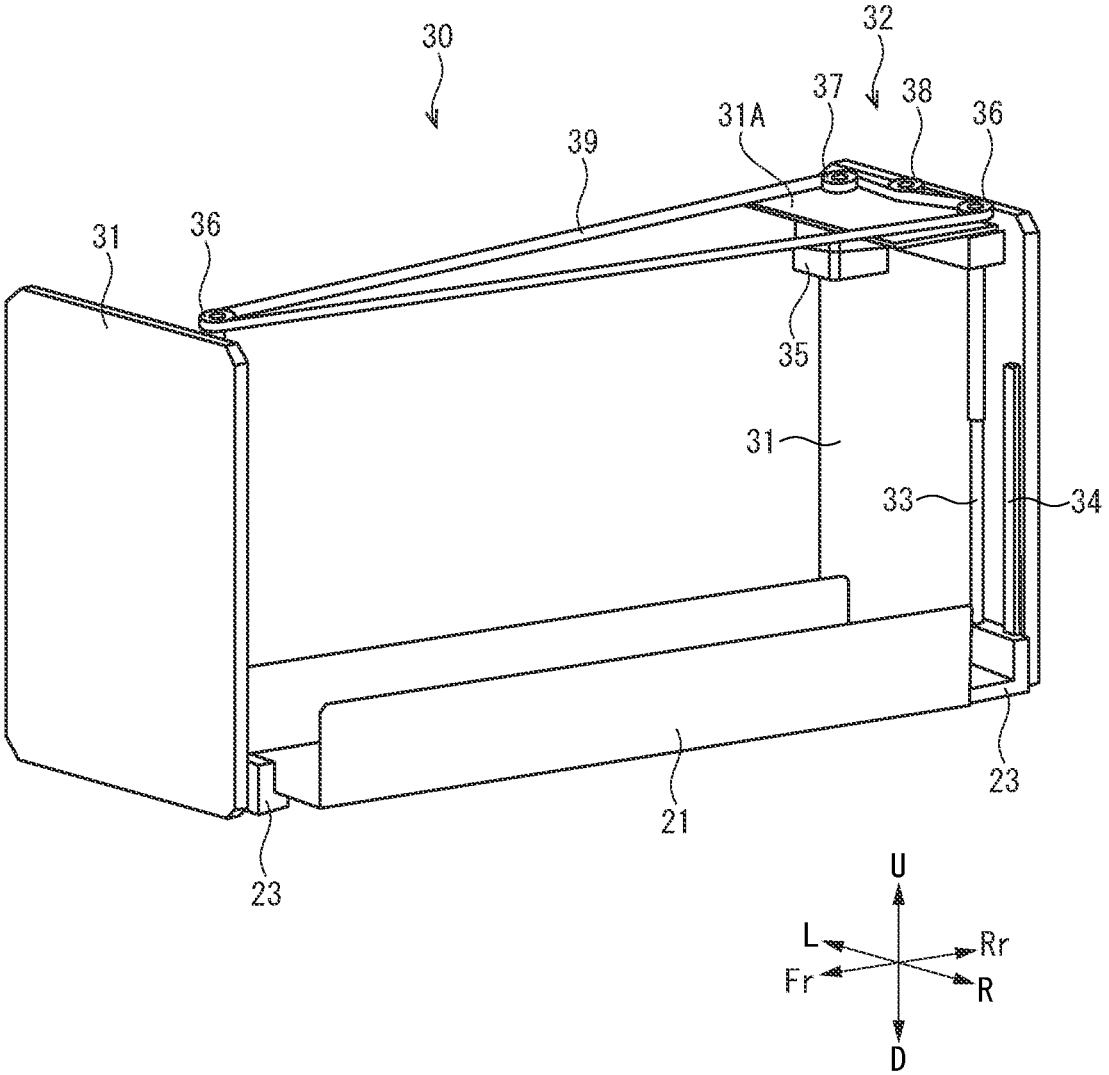
FIG. 5 is a perspective view showing a distance changing part in the image forming apparatus according to the embodiment of the present disclosure.

[Distance Changing Part] Next, with reference to FIG. 5, the distance changing part 30 will be described. FIG. 5 is a perspective view showing the distance changing part 30.

The distance changing part 30 includes a pair of plates 31 and a lifting drive part 32. The plates 31 are disposed vertically at an interval in the front-and-rear direction (the width direction). The lifting drive part 32 includes a pair of ball screws 33, a pair of guide rails 34 and a lifting motor 35.

The ball screws 33 and the guide rails 34 are supported on the inner surfaces of the plates 31 along the upper-and-lower direction. To the upper end portion of each ball screw 33, a driven sprocket 36 is fixed. The lifting motor 35 is fixed to the upper portion of the rear plate 31 via a mount plate 31A. To the output shaft of the lifting motor 35, a drive sprocket 37 is fixed. In the upper portion of the rear plate 31, an intermediate sprocket 38 is provided between the drive sprocket 37 and the driven sprocket 36. Around the sprockets 36, 37 and 38, a timing belt 39 is stretched. The lifting motor 35 is electrically connected to the controller 18 to be driven. The drive force (the rotational force of the drive sprocket 37) rotates the ball screws 33 via the timing belt 39.

The head unit 13 (the holder 21) is disposed between the plates 31, and is engaged with the ball screws 33 and the guide rails 34 via the brackets 23. By driving the lifting motor 35 in one direction and the counter direction, the ball screws 33 are rotated in one direction and the counter direction. As the ball screws 33 are rotated in one direction and the counter direction, the head unit 13 (the holder 21) is lifted and lowered along the guide rails 34. The distance changing part 30 moves the head unit 13 between a printing position P1 where the head unit 13 is closer to the conveyance part 14 (the sheet S) to perform a printing and a retreat position P2 where the head unit 13 is separated farther from the conveyance part 14 than the printing position P1.

Figure 6A:
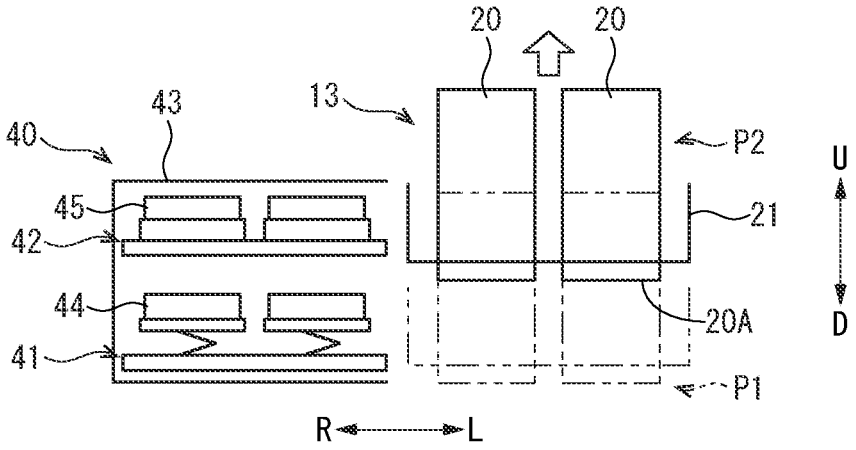
FIG. 6A is a side view showing the head unit and a maintenance part in a state where the head unit is moved to a retreat position, in the image forming apparatus according to the embodiment of the present disclosure.

[Maintenance Part] Next, with reference to FIG. 1 and FIG. 6A, the maintenance part 40 will be described. FIG. 6A is a side view showing the head unit 13 moved to the retreat position P2.

As shown in FIG. 1, the four maintenance parts 40 correspond to the four head units 13. For example, the maintenance part 40 is disposed on the left side of the corresponding head unit 13. That is, the four head units 13 and the four maintenance parts 40 are disposed alternately in the conveyance direction. The four maintenance parts 40 have the same structure, and in the specification, one maintenance part 40 will be described mainly.

As shown in FIG. 6A, the maintenance part 40 includes a capping unit 41, a wiping unit 42 and a support body 43. The capping unit 41 and the wiping unit 42 are disposed along the upper-and-lower direction, and are supported by the support body 43. The wiping unit 42 is disposed above the capping unit 41.

The capping unit 41 has three caps 44 which cover the nozzle surfaces 20A of the three ejection heads 20 (performing a capping operation). By capping the nozzle surfaces 20A, the capping unit 41 prevents the nozzle surfaces 20A from being clogged with the dried ink or the thickened ink. The capping unit 41 may include a suction mechanism (not shown) which sucks the ink clogged in the ejection nozzle forcefully.

The wiping unit 42 include three wiper blades 45 which wipe the nozzle surfaces 20A of the three ejection heads 20 (performing a wiping operation). The wiping unit 42 includes a wiper drive part (not shown) which moves the wiper blades 45 pressed on the nozzle surfaces 20A in the front-and-rear direction (the width direction). By moving the wiper blade 45 in the front-and-rear direction, the nozzle surface 20A is wiped. The wiping unit 42 removes the ink or the like adhered on the nozzle surface 20A and the ink to being clogged in the ejection nozzle, and repairs the clogging of the ejection head 20.

The support body 43 supports the capping unit 41 and the wiping unit 42 in a movable manner along the left-and-right direction (the conveyance direction). The support body 43 includes a drive part (not shown) to move the capping unit 41 and the others.

Figure 6B:
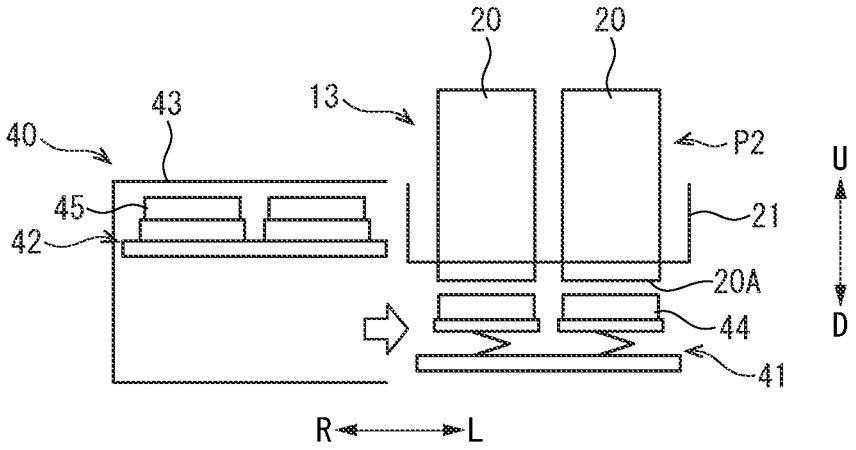
FIG. 6B is a side view showing the head unit and the maintenance part in a state where a capping unit faces the head unit, in the image forming apparatus according to the embodiment of the present disclosure.
Figure 6C:
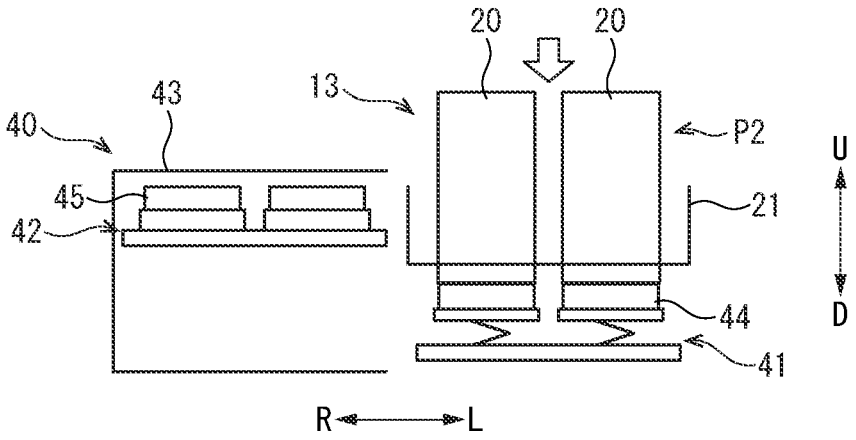
FIG. 6C is a side view showing the head unit and the maintenance part in a capping state, in the image forming apparatus according to the embodiment of the present disclosure.
Figure 7A:
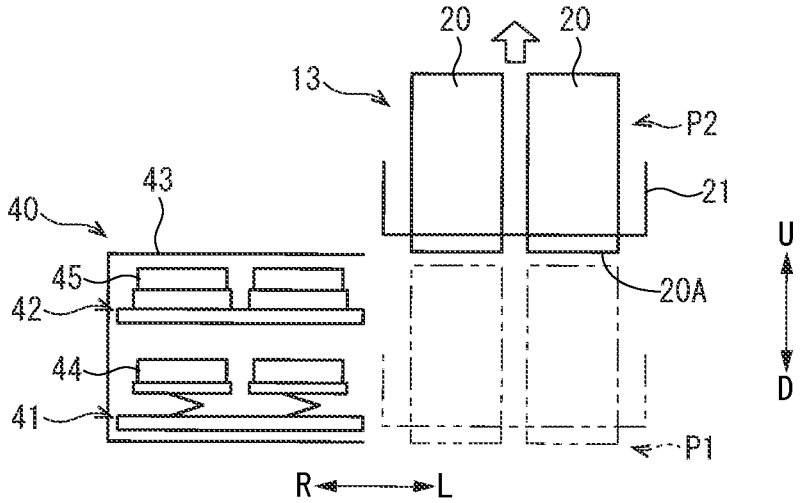
FIG. 7A is a side view showing the head unit and the maintenance part in a state where the head unit is moved to the retreat position, in the image forming apparatus according to the embodiment of the present disclosure.
Figure 7B:
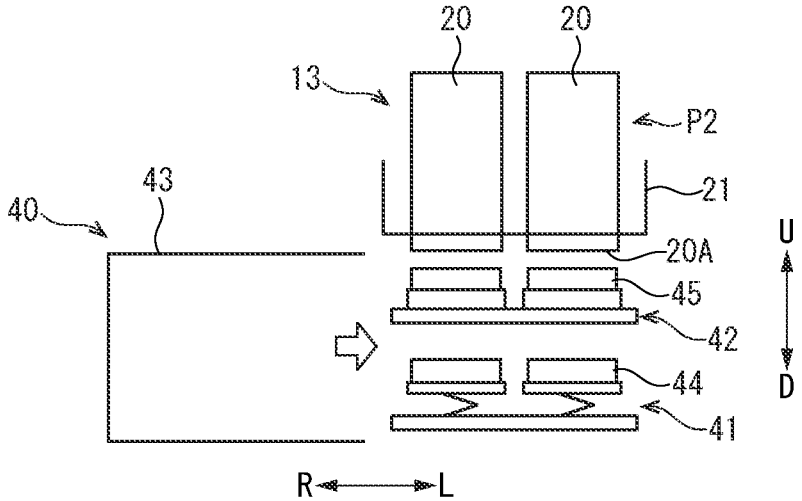
FIG. 7B is a side view showing the head unit and the maintenance part in a state where a wiping unit faces the head unit, in the image forming apparatus according to the embodiment of the present disclosure.
Figure 7C:
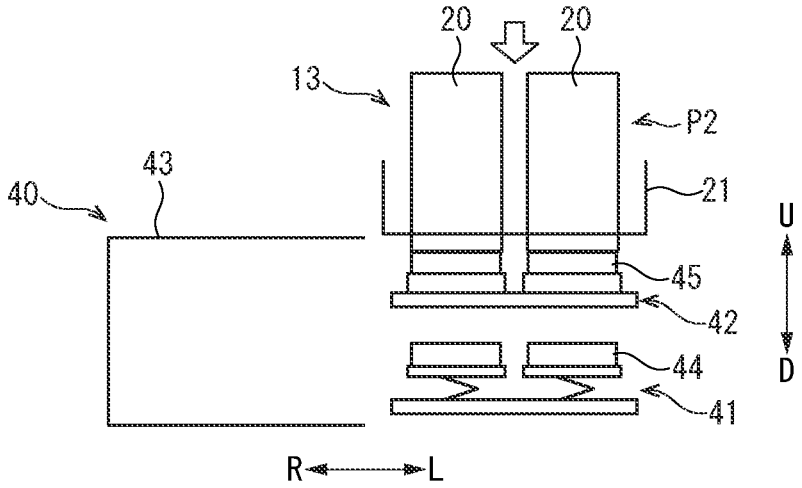
FIG. 7C is a side view showing the head unit and the maintenance part in a state where a wiping operation is permitted, in the image forming apparatus according to the embodiment of the present disclosure.

[Maintenance Operation] With reference to FIG. 6A to FIG. 6C and FIG. 7A to FIG. 7C, the maintenance operation by the maintenance part 40 will be described. FIG. 6B is a side view showing the capping unit 41 facing the head unit 13. FIG. 6C is a side view showing the capping unit 41 in the capping state. FIG. 7A is a side view showing the head unit 13 moved to the retreat position P2. FIG. 7B is a side view showing the wiping unit 42 facing the head unit 13. FIG. 7C is a side view showing the wiping unit 42 in the wiping allowed state.

When the capping is performed by the capping unit 41, as shown in FIG. 6A, the distance changing part 30 lifts the head unit 13 to the retreat position P2. Each nozzle surface 20A of each ejection head 20 is disposed above the cap 44. Then, as shown in FIG. 6B, the capping unit 41 is pushed rightward by the drive part so as to face the head unit 13 (the ejection heads 20) from below. Next, as shown in FIG. 6C, the distance changing part 30 lowers the head unit 13 by a small distance, and brings each ejection head 20 coming into tightly contact with the cap 44. Thereby, the capping is completed.

When the wiping is performed by the wiping unit 42, as shown in FIG. 7A, the distance changing part 30 lifts the head unit 13 to the retreat position P2. The nozzle surface 20A of the ejection head 20 is disposed above the wiper blade 45. The retreat position of the wiping unit 42 when the wiping is performed is set to be higher than the position when the capping is performed. The retreat position P2 is set to two levels at the capping and at the wiping, but they are referred to as the retreat position P2 simply without making any particular distinction between them, because the retreat position P2 is common in that they are separated upward from the printing position P1.

Next, as shown in FIG. 7B, the wiping unit 42 is pushed rightward by the drive part to face the head unit 13 (the ejection heads 20) from below. Next, as shown in FIG. 7C, the distance changing part 30 lowers the head unit 13 by a slight distance to bring the ejection heads 20 coming tightly contact with the wiper blades 45. By moving the wiper blades 45 in the front- and rear direction by the wiper drive part, the ink adhered to the nozzle surfaces 20A are wiped off. In FIG. 7B or the others, although the capping unit 41 is pushed out together with the pushing of the wiping unit 42, it may be configured that only the wiping unit 42 is pushed out.

As described above, the maintenance part 40 performs the maintenance operation. After the maintenance operation (the capping and the wiping) is completed, the distance changing part 30 lifts the head unit 13 by a slight distance, and the drive part returns the capping unit 41 and the wiping unit 42 to retreat them from the position below the head unit 13 (the ejection heads 20). After that, the distance changing part 30 lowers the head unit 13 from the retreat position P2 to the printing position P1. Although the head unit 13 is lifted and lowered at the maintenance operation, it may be lifted and lowered when the sheet jamming occurs in the conveyance part 14. That is, when the sheet jamming occurs, the distance changing part 30 moves the head unit 13 from the printing position P1 to retreat position P2, and then a user removes the jammed sheet S.

By the way, in order to form an appropriate image on the sheet S using the ejected ink droplets, it is required to set each head unit 13 perpendicular to the conveyance direction and to dispose the four head units 13 parallel to each other. Accordingly, the printing position P1 of each head unit 13 is preset in order to ensure the appropriate image and adjusted at the manufacturing of the image forming apparatus 1. Because the image forming apparatus 1 has a configuration that the head unit 13 is lifted and lowered at the maintenance operation and at the treatment of the sheet jamming, after the maintenance operation and the treatment of the sheet jamming are completed, it is important to return the head unit 13 moved to the retreat position P2 to the printing position P1 with high accuracy. Therefore, the image forming apparatus 1 according to the present embodiment is provided with a positioning mechanism 50 which positions the head unit 13 to the printing position P1 with high accuracy.

Figure 8:
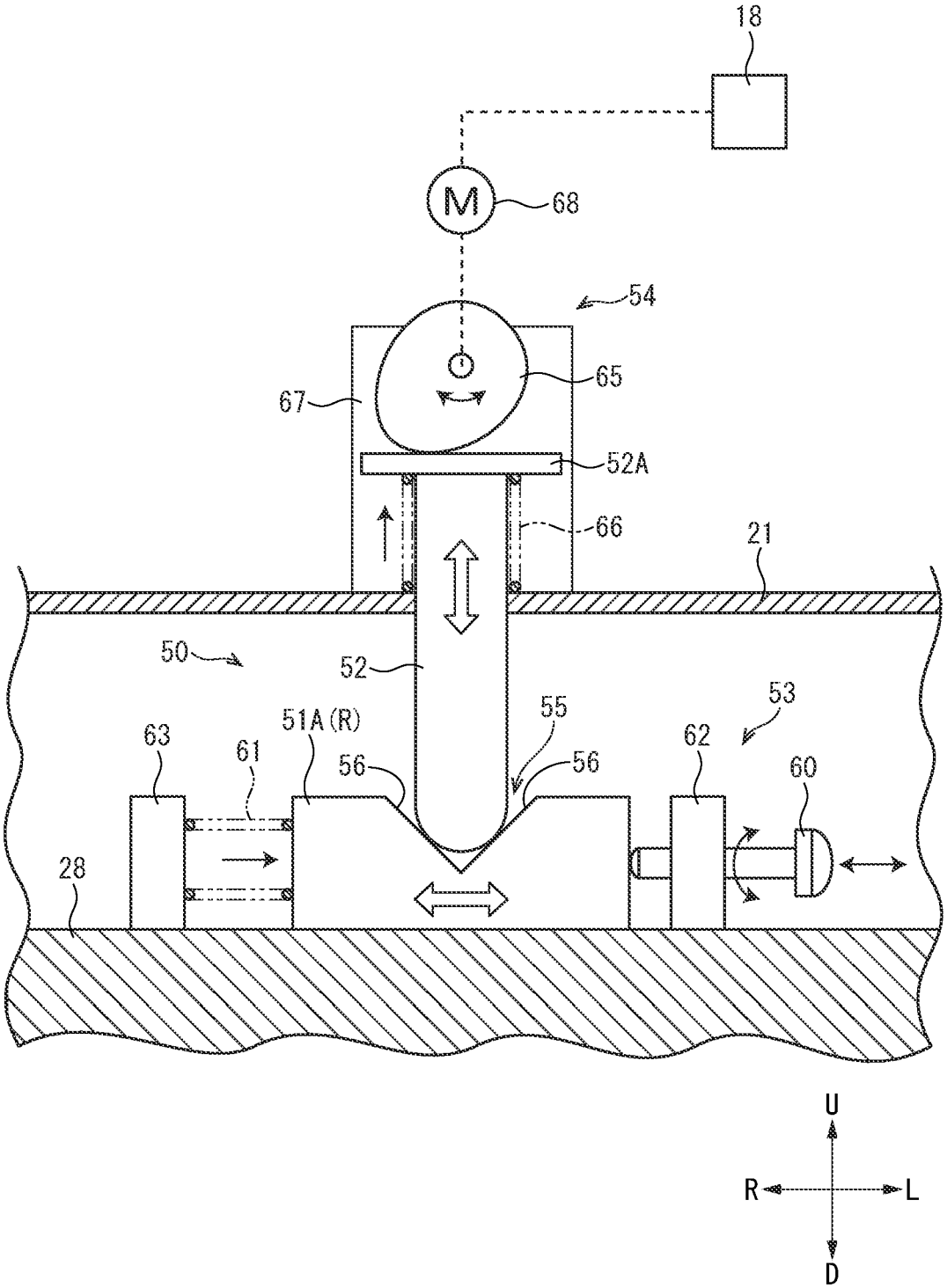
FIG. 8 is a sectional view showing a moving adjustment part and a distance adjustment part, viewed from the rear side, in the positioning mechanism according to the embodiment of the present disclosure.

[Positioning Mechanism] With reference to FIG. 2, FIG. 4 and FIG. 8, the positioning mechanism 50 will be described. FIG. 8 is a sectional view showing a moving adjustment part 53 and a distance adjustment part 54 viewed from the rear side.

The positioning mechanism 50 includes three blocks 51, three pins 52, the moving adjustment part 53, the distance adjustment part 54, in addition to the above-described head unit 13 and the distance changing part 30.

<Block> As shown in FIG. 2, the block 51 is made of metal, such as aluminum alloy and steel, and is formed in an approximately parallelepiped shape. Each block 51 has a positioning groove 55 on the upper surface. The positioning groove 55 has a pair of inclined surfaces 56 inclined to be narrow from the upper surface to the lower surface (as separated from the head unit 13). The positioning groove 55 is a groove formed by digging the block 51 in an approximately triangle shape. The inclined surfaces 56 are the inner surfaces of the positioning groove 55, and inclined into an approximately V-shape.

As shown in FIG. 3 and FIG. 4, the three blocks 51 are provided on the conveyance frames 28 disposed on the front side and the rear side of the conveyance belt 25. The three blocks 51 are disposed at intervals in the conveyance direction (the left-and-right direction) and in the width direction (the front-and-rear direction). Specifically, the three blocks 51 contain two first blocks 51A disposed at the interval in the front-and-rear direction and one second block 51B disposed away rightward from the front first block 51A. In the specification, in the description common in the first blocks 51A and the second block 51B, the Arabic numeral is only referred. In the specification, for convenience of explanation, the reference of the front first block 51A is added "(F)" and the reference of the rear first block 51A is added "(R)". In the description common in the two first blocks 51A and the second block 51B, the references of "(F)" and "(R)" are omitted.

As shown in FIG. 3, the two first blocks 51A are disposed at positions corresponding to both end portions of the head unit 13 in the front-and-rear direction, and the front first block 51A(F) and the second block 51B are disposed at positions corresponding to both end portions of the head unit 13 in the left-and-right direction. Since the head unit 13 is long in the front-and-rear direction, a distance (D) between the centers of the two first blocks 51A is set longer than a distance (W) between the centers of the first block 51A(F) and the second block 51B. The two first blocks 51A and the two ejection heads 20 disposed between the two first blocks 51A are arranged in a line in the front-and-rear direction. The first block 51A(F) and the second block 51B are arranged in a line in the left-and-right direction. Thus, the three blocks 51 are arranged at positions forming the apexes of the approximately right triangle in a plan view. The first block 51A(F) and the second block 51B are fixed on the upper surface of the conveyance frame 28, and the first block 51A(R) is provided on the upper surface of the conveyance frame 28 in a slidable manner along the left-and-right direction (the conveyance direction).

As shown in FIG. 2 and FIG. 3, the positioning grooves 55 of the two first blocks 51A are extended along the width direction, and the inclined surfaces 56 of the two first blocks 51A are formed in the same direction. The width direction is a direction crossing the conveyance direction on the conveyance surface of the conveyance part 14 on which the sheet S is conveyed with facing the head unit 13. The positioning groove 55 of the second block 51B is extended along the right-and-left direction (the conveyance direction), and the inclined surfaces of the second block 51B are formed in a direction of the inclined surfaces of the first block 51A which is turned by an angle between the conveyance direction and the width direction in a plan view. That is, in a plan view, an angel between the extension direction of the positioning groove 55 of the first block 51A and the extension direction of the positioning groove 55 of the second block 51B is equal to the angle between the conveyance direction and the width direction. That is, the pair of inclined surfaces 56 of the first block 51A is formed in a substantially V-shape when the first block 51A is viewed from the front (or the rear) side surface, and the pair of inclined surfaces 56 of the second block 51B is formed in a substantially V-shaped when the second block 51B is viewed from the lateral side surface. It is preferable that the angle between the conveyance direction and the width direction is 45° to 135°, further preferably 60° to 120°. Further, the conveyance direction and the width direction are preferably orthogonal to each other. The width direction of the positioning grooves 55 of the two first blocks 51A shown in FIG. 2 and FIG. 3 are orthogonal to the conveyance direction.

<Pin> As shown in FIG. 2 and FIG. 4, the pin 52 is made of metal such as aluminum allow and steel, and is formed in a rod-like shape having a circular cross section. The three pins 52 are provided in the head unit 13 so as to correspond to the three blocks 51. Specifically, the three pins 52 are arranged on the lower surface of the holder 21 at positions forming the apexes of the approximately right triangle in a bottom view. Each pin 52 extends downward from the holder 21. The lower end portion of the pin 52 is rounded in an approximately semicircular shape. The pin 52 has a diameter having such a degree to be fitted into a middle of the positioning groove 55 of the block 51. The pin 52 (the tip end portion) comes into two-point contact with the inclined surfaces 56 of the block 51 in a state where the head unit 13 is moved to the printing position P1 (see within the circle shown in FIG. 2). In a state where the head unit 13 is moved to the retreat position P2, the pin 52 is separated upward from the inclined surfaces 56 of the block 51 (not shown). Although described later, each pin 52 is lifted and lowered by the distance adjustment part 54, and is supported in a slidable manner with respect to the holder in the upper-and-lower direction. The upper end portion of each pin 52 penetrates the holder 21 and protrudes upward from the upper surface of the holder 21.

<Moving Adjustment Part> As shown in FIG. 8, the moving adjustment part 53 has a function of moving the first blocks 51A(R) in a moving direction crossing to the extension direction of the positioning groove 55 in a plan view, for example, in the left-and-right direction (the conveyance direction). The moving adjustment part 53 is provided on the rear conveyance frame 28. The moving adjustment part 53 includes an adjustment screw 60 and an adjustment spring 61. An angle between the extension direction and the moving direction is preferably set to 45° to 135°, further preferably 60° to 120°. Further, the extension direction is preferably orthogonal to the moving direction.

The adjustment screw 60 is supported by a screw support part 62 provided on the conveyance frame 28 on the left side of the first block 51A(R). Around the circumferential surface of the adjustment screw 60, a male thread (not shown) is formed, and a thread hole (not shown) having a female screw is formed in the screw support part 62. The adjustment screw 60 penetrates the screw hole of the screw support part 62 and is meshed with the female screw. The adjustment spring 61 is provided between a spring seat 63 provided on the conveyance frame 28 on the left side of the first block 51A(R) and the first block 51A(R). The adjustment spring 61 is a compression spring, and biases the first block 51A(R) against the tip end portion of the adjustment screw 60.

<Distance Adjustment Part> As shown in FIG. 8, the distance adjustment part 54 has a function of lifting and lowering the three pins 52. The distance adjustment part 54 is provided on the holder 21 of the head unit 13. The distance adjustment part 54 includes three lifting cams 65 and three lifting springs 66. The three lifting cams 65 have the same structure, and one lifting cam 65 will be described in the following. In the same manner, one lifting spring 66 will be described.

The lifting cam 65 is supported by a cam support part 67 provided on the holder 21 in a rotatable manner around an axis. The lifting cam 65 is an eccentric cam (a disk cam) whose radius between the axis and the circumferential surface is not equal. The cam surface of the lifting cam 65 comes into contact with the flange portion 52A formed in the upper end portion of the pin 52. The lifting cam 65 is connected to a cam motor 68 via a gear train (not shown). The cam motor 68 is a stepping motor which can control a rotational angle, and is electrically connected to the controller 18. The driving and the rotational speed of the cam motor 68 is controlled by the controller 18 such that the lifting cam 65 is rotated in one direction and in the counter direction.

The lifting soring 66 is wound around the upper portion of the pin 52, and disposed between the holder 21 and the flange portion 52A. The lifting spring 66 is a compression coil spring, and biases the flange portion 52A of the pin 52 against the cam surface of the lifting cam 65.

Figure 9:
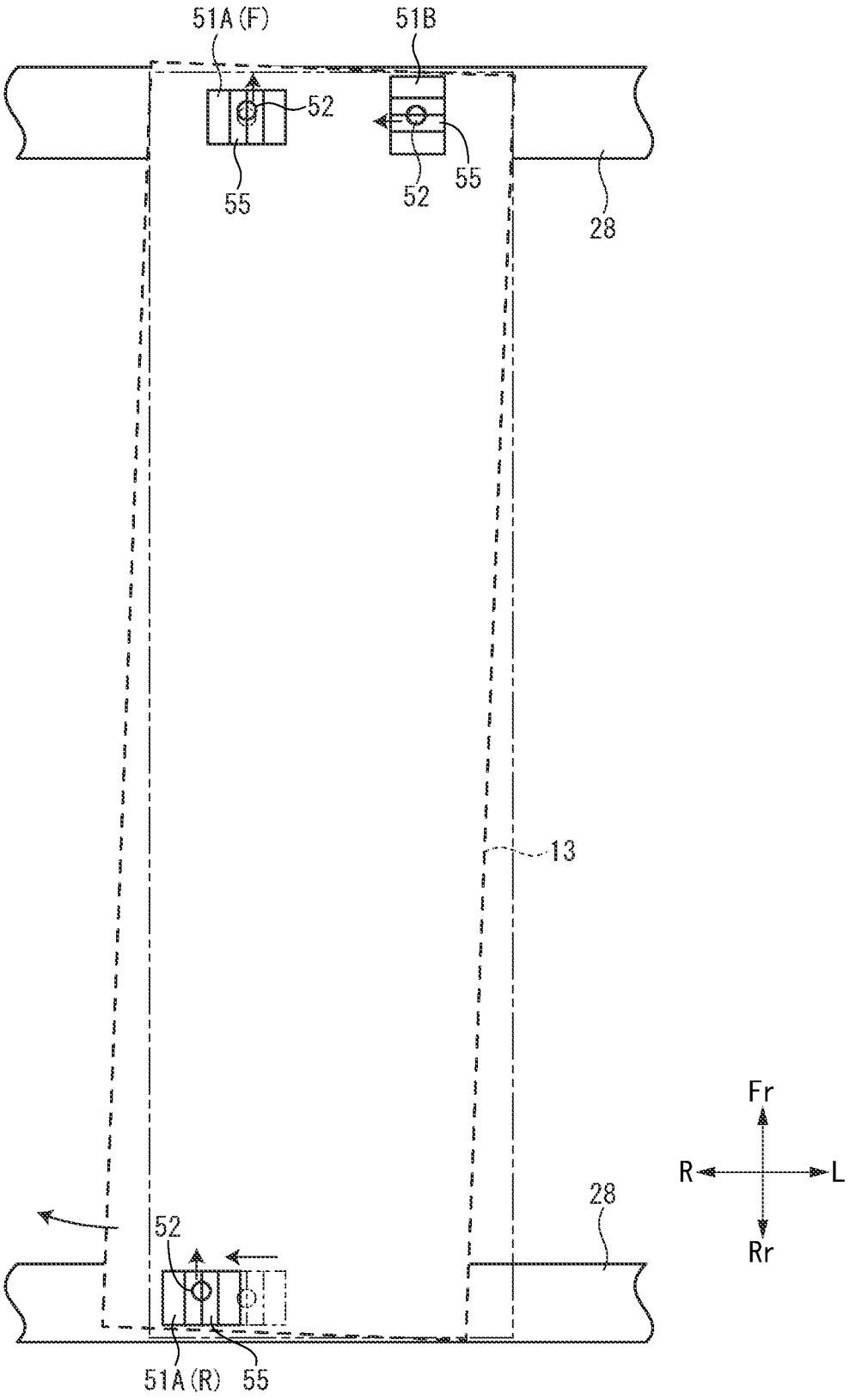
FIG. 9 is a plan view showing an operation of the moving adjustment part in the positioning mechanism according to the embodiment of the present disclosure.

[Positioning method of Head Unit] Next, with reference to FIG. 2, FIG. 8 and FIG. 9, the positioning method of the head unit 13 will be described. FIG. 9 is a plan view showing an operation of the moving adjustment part 53.

<Positioning Processing> After the maintenance operation and the treatment of the sheet jamming are completed, the controller 18 performs a positioning processing. In the positioning processing, the controller 18 controls the lifting motor 35 to lower the head unit 13 from the retreat position P2 to the printing position P1. As the head unit 13 is lowered, the tip end portion of the pin 52 begins to be inserted into the positioning groove 55 of the block 51. When the head unit 13 is lowered to the printing position P1, each of the three pins 52 (the tip end portions) come into two-point contact with the inclined surfaces 56 (see within the circle shown in FIG. 2). In the above manner, the head unit 13 is positioned at the accurate printing position P1.

According to the positioning mechanism 50 (the positioning method) of the present embodiment, the tip end portion of the pin 52 comes into two-point contact with the inclined surfaces, so that the pin 52 is immovable in the inclination direction and is stable. Further, even if the diameter of the pin 52, the width and depth of the positioning groove 55, and the like are slightly different from the design dimensions, the tip end portion of the pin 52 comes into two-point contact with the inclined surfaces 56, so that the occurrence of rattling can be suppressed. Further, even if the axial center of the pin 52 is slightly shifted from the center of the positioning groove 55, in the lowering process of the head unit 13 from the retreat position P2 to the printing position P1, the tip end portion of the pin 52 slides downward along one inclined surface 56 and eventually comes into two-point contact with the other inclined surface 56. That is, even if the position of the pin 52 and the positioning groove 55 is slightly shifted, the pin 52 surely comes into two-point contact with the inclined surfaces 56 while being guided by the inclined surfaces 56. Thus, it is not necessary to form the pin 52 and the positioning groove 55 into a complementary shape with high accuracy, and accurate positioning of the head unit 13 can be easily performed.

In the positioning mechanism 50 according to the present embodiment, an angle between the inclined surfaces 56 of the first block 51A and the inclined surfaces 56 of the second block 51B is 90° in a plan view. That is, the positioning grooves 55 of the two first blocks 51A is extended along the front-and-rear direction (the width direction), and the positioning groove 55 of the second block 51B is extended in the left-and-right direction (the conveyance direction). According to the above configuration, it becomes possible to position the two pins 52 engaged with the positioning grooves 55 of the two first blocks 51A in the conveyance direction, and it becomes possible to position the pin 52 engaged with the positioning groove 55 of the second block 51B in the width direction. Therefore, it becomes possible to position the head unit 13 in the conveyance direction, in the width direction, and in the rotational direction on a plan.

<Moving Adjustment Processing> At the manufacturing of the image forming apparatus 1 and the periodical maintenance, the operator performs the moving adjustment processing. In the moving adjustment processing, the first block 51A(R) is moved along the left-and-right direction (the conveyance direction) to perform various adjustment. For example, each head unit 13 is moved in a direction perpendicular to the conveyance direction, and the four head units 13 are disposed parallel to each other. The moving adjustment processing may be performed before the above-described positioning processing or after the positioning processing.

Specifically, when the operator screws an adjustment screw 60 (see FIG. 8), as shown in FIG. 9, the first block 51A(R) is moved rightward against the biasing force of the adjustment spring 61. Then, the head unit 13 is turned in the clockwise direction in a plan view while each pin 52 slides along the positioning groove 55. Therefore, the posture of the head unit 13 is changed in a plan view (adjusted). Further, when the operator screws the adjustment screw 60 in a draw-out direction, the first block 51A(R) is moved leftward by the biasing force of the adjustment spring 61, and the head unit 13 is turned in the counterclockwise direction in a plan view (not shown).

According to the positioning mechanism 50 (the positioning method) of the present embodiment described above, the position of the pins 52 and the blocks 51 in a plan view can be adjusted by the moving adjusting part 53 which moves the first block 51A(R) along the conveyance direction. Thus, the head unit 13 can be more accurately positioned, and each head unit 13 can be disposed in a posture orthogonal to the conveyance direction, and the four head units 13 can be disposed in parallel to each other.

In the positioning mechanism 50 according to the present embodiment, the moving adjustment part 53 moves the first block 51A(R), which is located on the rear side of the head unit 13 (the other side in the width direction) alone, along the conveyance direction. According to this configuration, even if the rear first block 51A(R) is moved by a large distance, the forward moving amount of the head unit 13 can be reduced. Thus, the head unit 13 can be finely adjusted in the rotational direction.

<Distance Adjustment Processing> Before the image forming operation, for example, the controller 18 performs the distance adjustment processing depending on the thickness of the sheet S used in the printing. In the distance adjustment processing, the three pins 52 are lifted and lowered so as to change (adjust) a distance between the head unit 13 (the ejection heads 20) and the conveyance part 14 (the conveyance belt 25). The thickness of the sheet S may be input manually from the operator using a touch panel (not shown) of the image forming apparatus 1, or may be input to the controller 18 from a detection sensor (not shown) for detecting a thickness of the sheet S provided in the sheet feeding cassette 3A or the manual bypass sheet feeding tray 3B. The distance adjustment processing may be performed before the above-described positioning processing or after the positioning processing.

Specifically, as shown in FIG. 8, the controller 18 controls the cam motor 68 to rotate the lifting cam 65 to a desirable angle. With the rotating of the lifting cam 65, the pins 52 are pushed down against the biasing forces of the lifting springs 66 or are pushed up by the biasing forces of the lifting springs 66. The lifting cam 65 is maintained at the desirable angle, and the protruding amount of the pin 52 from the holder 21 is changed. By fitting the tip end portions of the pins 52 into the positioning holes 55 of the blocks 51, a height of the head unit 13 with respect to the conveyance part 14 is changed. A relationship between the rotational angle of the cam motor 68 and the pushing amount of the pin 52 by the lifting cam 65 is previously stored in the memory of the controller 18.

According to the positioning mechanism 50 (the positioning method) of the present embodiment described above, the distance adjustment part 54 lifts and lowers the pins 52 so that a distance between the head unit 13 and the conveyance part 14 can be adjusted. Therefore, a height of the head unit 13 can be adjusted depending on the thickness of the sheet S to be printed, so that it becomes possible to keep the distance between the sheet S and the nozzle surfaces 20A (the ejection distance of the ink droplet) constant. As a result, it becomes possible to ensure suitable image forming (printing).

In the positioning mechanism 50 according to the present embodiment, the blocks 51 are provided in the conveyance part 14 (the upper surface of the conveyance frame 28), and the pins 52 are provided in the head unit 13 (the lower surface of the holder 21), but, the present disclosure is not limited to this. The blocks 51 may be provided in the head unit 13, and the pins 52 may be provided in the conveyance part 14 (not shown).

In the positioning mechanism 50 according to the present embodiment, the distance D between the two first blocks 51A is set to be longer than the distance W between the first block 51A(F) and the second block 51B, but, the distance (D) may be set to be shorter than the distance (W), or be equal to the distance (W) (not shown). The three blocks 51 are disposed at positions forming the apexes of an approximately right triangle in a plan view, but may be disposed at positions forming the apexes of another triangle, such as an isosceles triangle and an equilateral triangle (not shown).

In the positioning mechanism 50 according to the present embodiment, the positioning groove 55 having an approximately V-shaped cross section is formed in the block 51, but, the present disclosure is not limited to this. The positioning groove 55 may have the pair of inclined surfaces 56, and for example, may be formed in an approximately trapezoid shape having the inclined surfaces 56 and a horizontal surface between the lower ends of the inclined surfaces 56 (not shown).

In the positioning mechanism 50 according to the present embodiment, the positioning groove 55 of the first block 51A is extended in the front-and-rear direction (the width direction), and the positioning groove 55 of the second block 51B is extended in the left-and-right direction (the conveyance direction), but, the present disclosure is not limited to this. The positioning groove 55 of the first block 51A may be extended in the left-and-right direction (the conveyance direction), and the positioning groove 55 of the second block 51B may be extended in the front-and-rear direction (the width direction) (not shown).

In the positioning mechanism 50 according to the present embodiment, the tip end portion of the pin 52 is rounded in a semicircular shape, but, the present disclosure is not limited to this. For example, the tip end portion of the pin 52 may be flat (not shown). That is, the tip end portion of the pin 52 may have any shape if it comes into two-point contact with the inclined surfaces 56.

In the positioning mechanism 50 according to the present embodiment, the first block 51A(R) moved by the moving adjustment part 53 is slidable in the left-and-right direction and each pin 52 lifted and lowered by the distance adjustment part 54 is slidable in the upper-and-lower direction, but, the present disclosure is not limited to this. For example, at least one of the moving adjustment part 53 and the distance adjustment part 54 may be eliminated. In this case, the first block 51A(R) and each pin 52 may be fixed.

In the positioning mechanism 50 according to the present embodiment, the moving adjustment part 53 moves the first block 51A(R) along the conveyance direction, but, the present disclosure is not limited to this. The moving adjustment part 53 may move at least one block 51 along a direction crossing the extension direction of the positioning groove 55 in a plan view. For example, the moving adjustment part 53 may move all the three blocks 51 along the conveyance direction or/and the width direction (not shown). The moving adjustment part 53 moves the block 51, but, the present disclosure is not limited to this. The moving adjustment part may move at least one pin 52 along a direction crossing the extension direction of the positioning groove 55 in a plan view (not shown).

In the positioning mechanism 50 according to the present embodiment, the distance adjustment part 54 lifts and lowers the three pins 52, but the present disclosure is not limited to this. The distance adjustment part 54 may lift and lower at least one pin 52 (not shown). The distance adjustment part 54 may lift and lower at least one block 51 without lifting and lowering the pin 52 (not shown).

In the positioning mechanism 50 according to the present embodiment, the moving adjustment part 53 includes the adjustment screw 60, but it may include an eccentric cam (not shown) like the distance adjustment part 54. The moving adjustment part 53 includes the lifting cam 65, but may include a screw (not shown) like the moving adjustment part 53. The moving adjustment part 53 and the distance adjustment part 54 may use a ball screw, a solenoid, a piston and cylinder, and a rack and pinion (not shown) as a mechanism for moving (lifting and lowering) the block 51 and the pin 52. The distance changing part 30 uses the ball screw 33 as a mechanism for lifting and lowering the head unit 13, but, the present disclosure is not limited to this. The distance changing part 30 may use a cam mechanism, a solenoid, a piston and cylinder, and a rack and pinion (not shown) like the distance adjustment part 54.

In the positioning mechanism 50 according to the present embodiment, the moving adjustment part 53 is driven manually, and the distance adjustment part is driven by the motor, but, the present disclosure is not limited to this. The moving adjustment part 53 may be driven by a motor and the distance adjustment part 54 may be driven manually (not shown).

The image forming apparatus 1 according to the present embodiment is the color printer, but is not limited to the color printer, and may be a monochrome printer, a copying machine, a facsimile, or the like.

It should be noted that the description of the above embodiment shows an aspect of the head unit positioning mechanism, the image forming apparatus, and the head unit positioning method according to the present disclosure, and the technical scope of the present disclosure is not limited to the above embodiment. The present disclosure may be variously modified, substituted or changed without departing from the spirit of the technical idea, and the claims include all embodiments that may be included within the scope of the technical idea.

The invention claimed is:

1. An image forming apparatus comprising:

a conveyance part which conveys a medium along a conveyance direction;

a head unit disposed so as to face the conveyance part and ejecting liquid droplets to the medium;

a distance changing part which moves the head unit between a printing position where a printing operation is performed on the medium and a retreat position separated away from the conveyance part farther than the printing position;

three blocks provided in one of the conveyance part and the head unit at intervals in the conveyance direction and a width direction crossing the conveyance direction; and three pins provided in the other of the conveyance part and the head unit at positions facing the three blocks, wherein each of the three blocks has a positioning groove having a pair of inclined surfaces which are inclined such that the positioning groove becomes narrower as the positioning groove is separated away from the other of the conveyance part and the head unit, the three blocks contain:

two first blocks in which the positioning grooves are extended along one of the conveyance direction and the width direction, and the inclined surfaces are formed in the same direction; and one second block in which the positioning groove is extended along the other of the conveyance direction and the width direction, and the inclined surfaces are formed in a direction of the inclined surfaces of the first block which is turned by an angle between the conveyance direction and the width direction in a plan view, and the pins come into two-point contact with the inclined surfaces of the blocks in a state where the head unit is positioned in the printing position.

2. The image forming apparatus according to claim 1, further comprising:

a moving adjustment part which moves at least one of the blocks or at least one of the pins along a direction crossing an extension direction of the positioning groove in a plan view.

3. The image forming apparatus according to claim 2, wherein the head unit is formed longer in the width direction than in the conveyance direction, the two first blocks are provided at positions corresponding to both end portions of the head unit in the width direction, one of the two first blocks and the second block are provided at positions corresponding to both end portions of the head unit in conveyance direction, the positioning groove of the first block is extended along the width direction, and the positioning groove of the second block is extended along the conveyance direction, and the moving adjustment part moves the other of the two first blocks or the pin which can contact with the other of the two first blocks, along the conveyance direction.

4. The image forming apparatus according to claim 1, further comprising:

a distance adjustment part which moves at least one of the blocks or at least one of the pins so as to change a distance from the conveyance part.

5. The image forming apparatus according to claim 1, wherein the blocks are provided in the conveyance part, and the pins are provided in the head unit.

6. The image forming apparatus according to claim 1, wherein the positioning groove has a triangular cross-sectional shape, and a tip end portion of the pin is formed in a hemispherical shape.

7. A head unit positioning method, in which the head unit is disposed so as to face a conveyance part conveying a medium along a conveyance direction and is movable between a printing position where the head unit ejects ink droplets to the medium to perform a printing operation and a retreat position separated away from the conveyance part farther than the printing position, the head unit positioning method comprising:

a step for providing three blocks in one of the conveyance part and the head unit at intervals in the conveyance direction and a width direction crossing the conveyance direction, in which each of the three blocks has a positioning groove having a pair of inclined surfaces which are inclined such that the positioning groove becomes narrower as the positioning groove is separated away from the other of the conveyance part and the head unit, the three blocks contain:

two first blocks in which the positioning grooves are extended along one of the conveyance direction and the width direction, and the inclined surfaces are formed in the same direction; and one second block in which the positioning groove is extended along the other of the conveyance direction and the width direction, and the inclined surfaces are formed in a direction of the inclined surfaces of the first block which is turned by an angle between the conveyance direction and the width direction in a plan view;

a step for providing three pins in the other of the conveyance part and the head unit at positions facing the three blocks in a state where the head unit is positioned in the printing position; and a positioning step for bringing the three pins into two-point contact with the inclined surfaces of the three blocks.

8. The head unit positioning method according to claim 7, further comprising:

a distance adjustment step for moving at least one of the blocks or at least one of the pins along a direction crossing an extension direction of the positioning groove in a plan view before or after the positioning step.

9. The head unit positioning method according to claim 7, wherein the head unit is formed longer in the width direction than in the conveyance direction, the two first blocks are provided at positions corresponding to both end portions of the head unit in the width direction, one of the two first blocks and the second block are provided at positions corresponding to both end portions of the head unit in conveyance direction, the positioning groove of the first block is extended along the width direction, and the positioning groove of the second block is extended along the conveyance direction, and in the moving adjustment step, the other of the two first blocks or the pin which can contact with the other of the two first blocks is moved along the conveyance direction.

10. The head unit positioning method according to claim 7, further comprising:

a distance adjustment step for moving at least one of the blocks or at least one of the pins so as to change a distance from the conveyance part before or after the positioning step.

* * * * *